US005375438A

United States Patent [19]

Babuin

[11] Patent Number: 5,375,438

[45] Date of Patent: Dec. 27, 1994

[54] WATER INLET ARRANGEMENT FOR WASHING MACHINES

[75] Inventor: Piero Babuin, Pordenone, Italy

[73] Assignee: Zanussi Elettrodomestici S.p.A., Italy

[21] Appl. No.: 148,902

[22] Filed: Nov. 8, 1993

[30] Foreign Application Priority Data

Nov. 11, 1992 [IT] Italy ..... PN92A000085

[51] Int. Cl.[5] ..... D06F 39/02

[52] U.S. Cl. ..... 68/17 R; 137/268

[58] Field of Search ..... 68/17 R; 134/93, 99.2; 137/205.5, 268, 564.5; 422/266

[56] References Cited

U.S. PATENT DOCUMENTS

| | | | |
|---|---|---|---|
| 2,228,914 | 1/1941 | Pierce | 68/17 R |
| 2,711,928 | 6/1955 | Randa | 137/268 X |
| 2,976,879 | 3/1961 | De Lisle et al. | 137/268 X |
| 3,258,792 | 7/1966 | Rickel | 68/17 R X |
| 3,720,230 | 3/1973 | Stockstill et al. | 137/564.5 |

FOREIGN PATENT DOCUMENTS

| | | | |
|---|---|---|---|
| 2588292 | 4/1987 | France | 68/17 R |
| 1610190 | 12/1967 | Germany . | |
| 6919393 | 10/1970 | Germany . | |
| 2541193 | 3/1977 | Germany | 68/17 R |

*Primary Examiner*—Philip R. Coe

*Attorney, Agent, or Firm*—Pearne, Gordon, McCoy & Granger

[57] ABSTRACT

A clothes washing machine, in particular of the household type, includes a washing tub (1), a drum (2) holding the washload, a water inlet conduit (5) from the water supply mains, an electromagnetic valve (6) provided in the conduit, an offshoot conduit (7) downstream of the electromagnetic valve and an air break (8). A water dispenser (3) is located above a plurality of compartments (4) for holding washing and rinsing agents. A siphon (10) is installed between the compartments and the washing tub, and a conduit (9) is positioned between the siphon and the water dispenser. A second water offshoot conduit (13) is provided with a respective air break (15) and is situated between the electromagnetic valve (6) and the air gap (8), wherein the second water offshoot conduit (13) flows into the conduit (9). The air gap is formed by an interruption through an injector (14) located in a vertical descending section of the second offshoot conduit, whereas water (16) issuing from the injector (14) flows into the conduit (9).

5 Claims, 4 Drawing Sheets

WATER INLET ARRANGEMENT FOR WASHING MACHINES

BACKGROUND OF THE INVENTION

1. Field of the Invention

This invention relates to clothes washing machines, in particular of the household type, which are provided with a particular water inlet arrangement to fill water into a washing tub.

2. Description of the Related Art

Clothes washing machines are known, particularly of the front-loading type, in which water filling occurs from water delivery mains outside the machine into the washing tub through a water supply conduit. The following components are commonly disposed in the conduit in the given order: an electromagnetic inlet valve, an "air break" (required by applicable regulations), a water dispenser, several compartments containing washing and rinsing products and disposed below the water dispenser and, finally, a conduit conveying the water from said compartments into the washing tub.

Such a type of water fill arrangement is particularly effective if the amount of water to be filled into the tub is not excessively large, i.e. around ten liters, and the detergent is not foaming excessively.

Under such circumstances, in fact, the necessary amount of water is able to reach the washing tub in an acceptably short period of time, although its flow is actually restrained by both said air break and said water dispenser which form hydrodynamic resistances along the flow path. Furthermore, the type of detergent generally used is unlikely to generate foam to any significant extent between said elements due to its inherent properties and to the fact that the amount of water being let into the compartments is quite limited. Above all, said water is let in at a relatively low pressure due to the fact that this takes place downstream of the air break, which is commonly known to cause the water pressure in the downstream flow path to fall off abruptly to almost inappreciable values.

On the other hand, as is required in certain important markets, such as the United States, washing cycles should be kept as short as possible. Further, under-utilization of a relatively high amount of water (i.e. almost three times the typical amount required by European-type washing machines) should be avoided. Also, high-sudsing laundering products are used. Thus, a European-type washing machine presents a number of serious drawbacks.

In the first place, filling in large amounts of water through the normal water inlet circuit including such elements as an air break, water dispenser, product compartments and a siphon, requires correspondingly long periods of time, due mainly to the presence of the siphon. This is clearly contrary to the requirement of short laundering processes prevailing in said marketplace.

Additionally, the particularly high-sudsing property that is peculiar of detergents used in such marketplaces as the United States give rise to considerable foam generation from the siphon and the compartments containing the laundering products. The foam leaking through said siphon and said compartments would eventually flow out of the machine. Furthermore, there may be also direct foam generation in the laundering product compartments when the water is conveyed into them to flush away the product contained therein, and this would of course make things worse.

Finally, the large amount of water used in the process would give rise to a lot of vapors being generated, which would then leak outside, as the foam leaks.

To eliminate such drawbacks, clothes washing machines have been disclosed, for instance in DE 6 919 393, which are provided with a siphon arranged to retain said foam and said vapors.

However, such a solution is not wholly effective in solving the problems, since in all cases the whole amount of water still must flow through the laundering product compartments. Thus, the period of time for the water to flow into the washing tub is unacceptably long as discussed above. Furthermore, such washing machines operate according to the well known principle of recirculation of the washing liquid which requires a greater complexity in construction and higher costs in production.

Clothes washing machines are also known, for instance from DE 1 610 190, in which the water needed for washing is partly filled through the compartments containing the laundering products and partly delivered directly into the washing tub. These washing machines, however, still have a drawback in that they do not actually prevent the foam from possibly reaching up to said compartments. Furthermore, even these washing machines operate according to the aforementioned principle of recirculation of the washing liquid and are therefore encountering the same problems as cited above in connection therewith.

Clothes washing machines are also known, for instance from U.S. Pat. No. 3,258,792, in which the whole amount of water is filled directly into the washing tub, while the laundering products in such washing machines are flushed into the tub through a flow of water being mechanically circulated in a hermetically sealed reservoir containing such products. It will therefore be appreciated that these machines do not eliminate the need to provide a specially arranged recirculation circuit and, as a consequence, still have the aforecited problems of complex construction and expensive manufacturing.

SUMMARY OF THE INVENTION

A solution to the above cited problems can be found in the elimination of the siphon and letting the water and detergent mixture fall directly onto the bottom of the washing tub. This would enable the siphon to be excluded from the circuit and the corresponding action, i.e. a slowing down of the water flow moving towards the inner side of the washing tub, to be avoided. Furthermore, this would also do away with the possibility of foam and/or vapors escaping through the siphon.

On the other hand, the presence of the siphon, especially if its outlet nozzle is arranged in correspondence of a bellows-like door gasket and oriented towards the inner side of the washload-containing drum, would enable a jet of water mixed with detergent to be sprayed directly onto the washload arranged substantially in the lower section of the drum. Thus, the washing effect is enhanced in a significant way, as anyone skilled in the art is able to appreciate.

It would therefore be desirable, and is a purpose of the present invention, to provide a clothes washing machine, in particular of the household type, which operates in a generally traditional way (without mechanical recirculation of the washing liquid), is provided with an arrangement capable of eliminating the aforecited manufacturing burdens and functional drawbacks, and is able to regularly perform its water filling and detergent flushing function without suffering any constructional complication, while making use of normally available techniques.

BRIEF DESCRIPTION OF THE DRAWINGS

The invention will be further described below, by way of non-limiting example, with reference to the accompanying drawings in which.

DETAILED DESCRIPTION OF THE PREFERRED EMBODIMENTS

Figure 1:
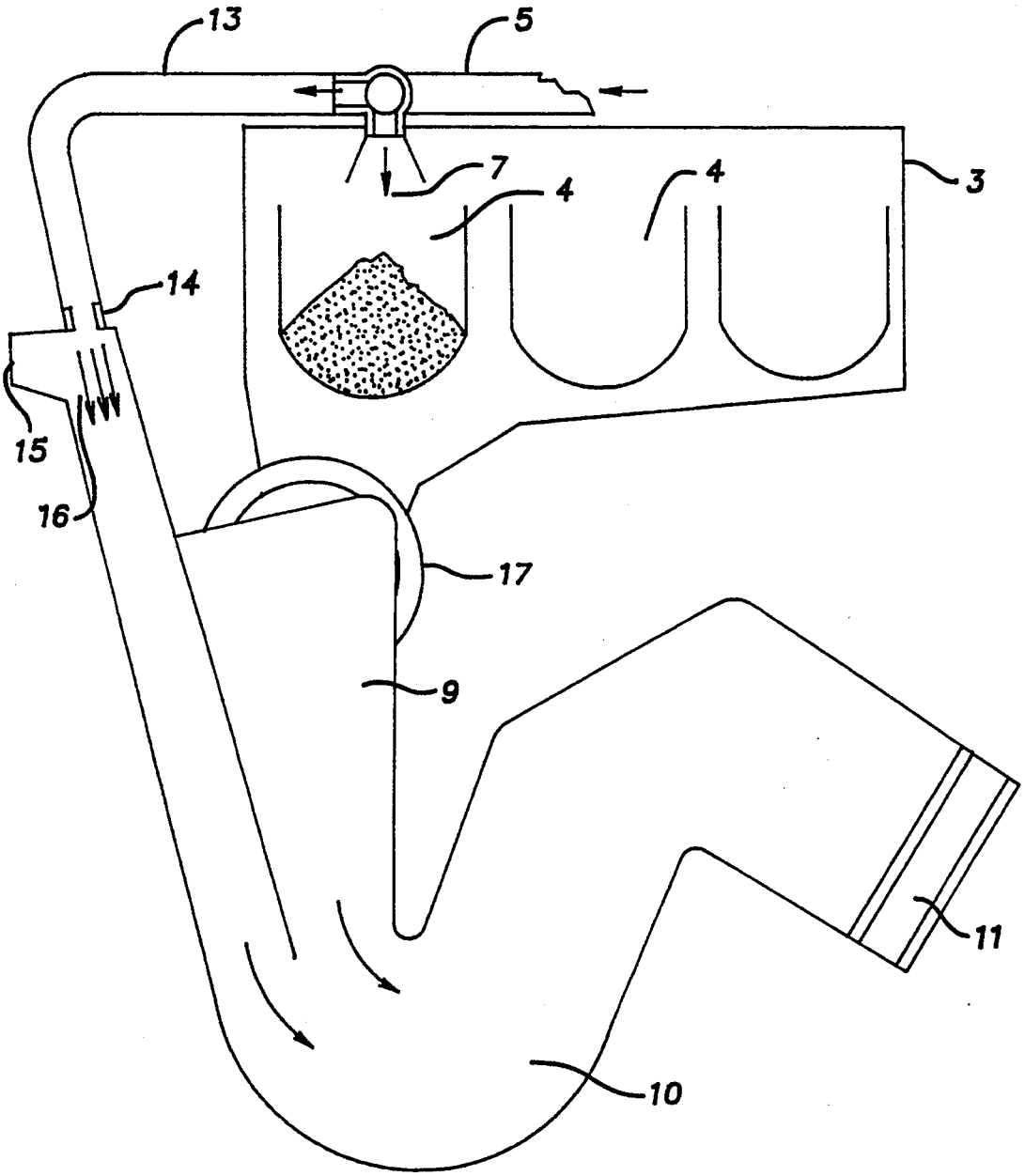
FIG. 1 is a view of a portion of a vertical cross-section of a clothes washing machine according to the present invention.
Figure 2:
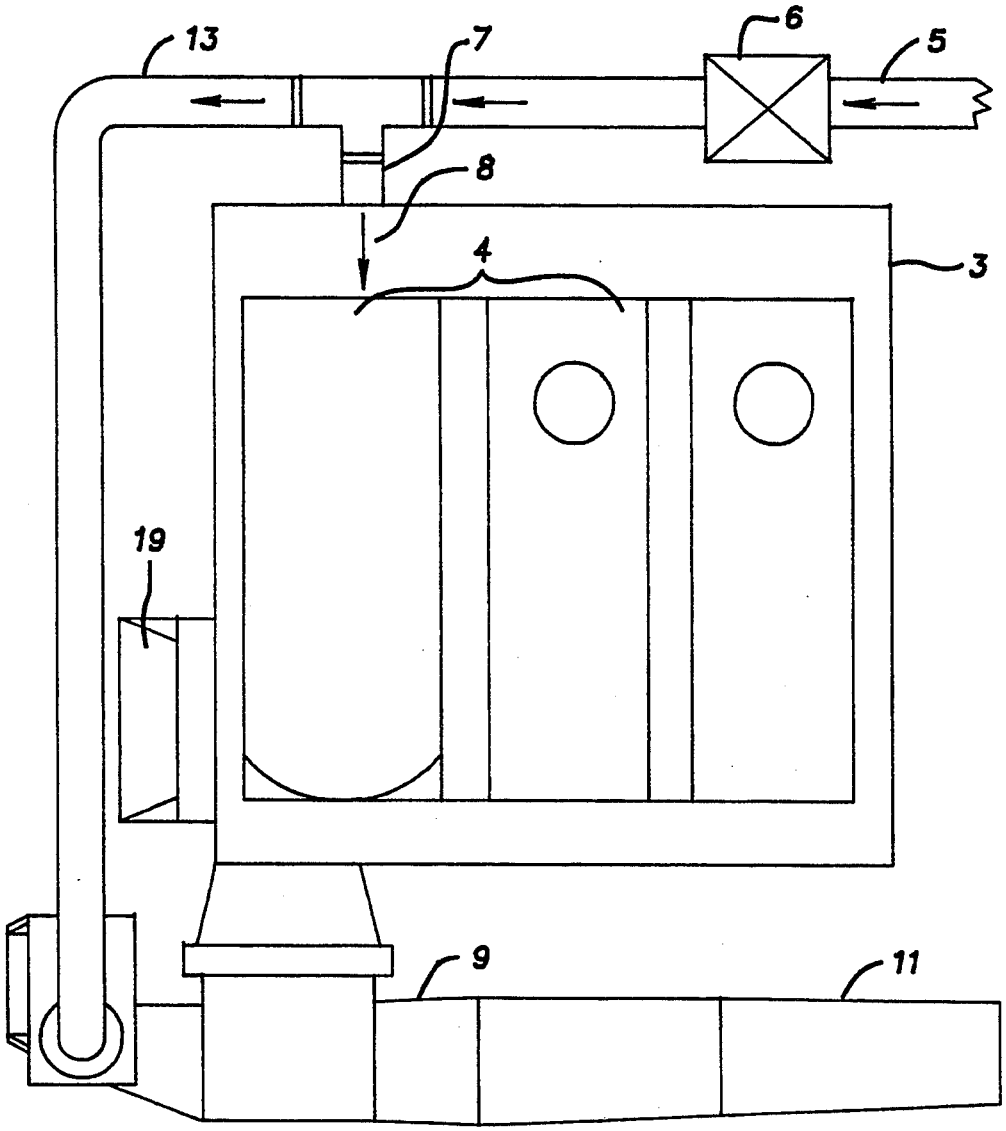
FIG. 2 is a schematical plan view from above of the arrangement according to the present invention.
Figure 3:
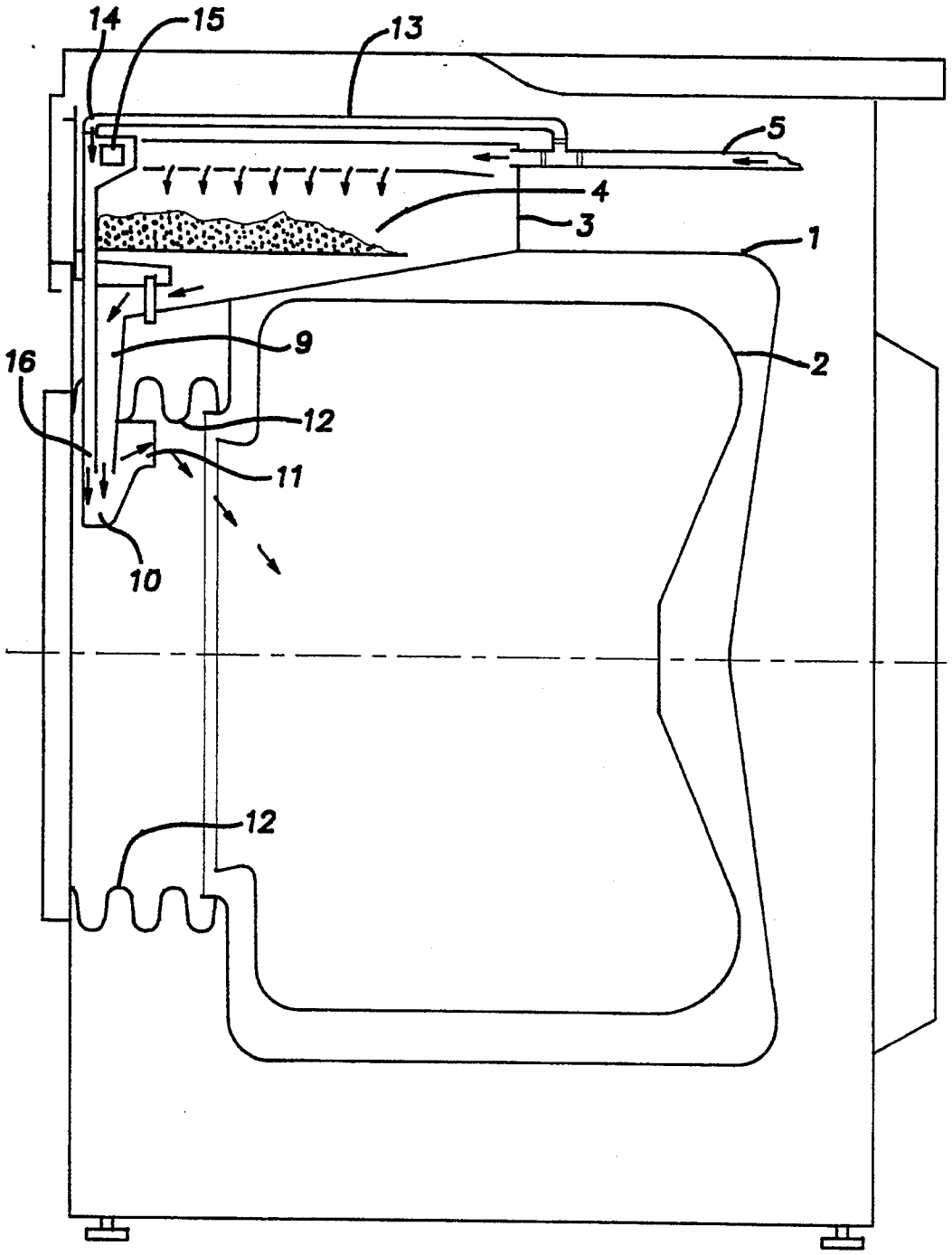
FIG. 3 is an elevational view in section of the above cited arrangement and the tub-drum assembly.

Referring to the above listed Figures, it can be noticed that they illustrate a washing tub 1, a washload-containing drum 2, a laundering product dispenser 3 comprising a plurality of compartments 4, a water inlet conduit 5 from water supply mains, an electromagnetic valve 6 installed in said conduit 5, and a first offshoot conduit 7 branching off said inlet conduit 5 downstream of the electromagnetic valve. Said offshoot conduit 7 conveys water from the water supply mains into the laundering product dispenser 3 through an air break 8. A conduit 9 conveys towards a siphon 10 water mixed with the laundering product flowing out of the dispenser 3. An outlet nozzle 11 of said siphon 10 is arranged to spray the liquid into said drum 2 from a location situated in an upper portion of a bellows-like door gasket 12.

At a point located downstream of the electromagnetic water-inlet valve 6, approximately in correspondence of said first offshoot conduit 7, a second offshoot conduit 13 is provided to convey a corresponding flow of water to the inlet of the siphon 10.

Said second offshoot conduit 13 is terminated by an outflow nozzle 14 that opens into a corresponding air break arrangement 15.

In a most advantageous manner, the outflow nozzle 14 is oriented vertically downwardly in and flows into the same conduit 9 coming from the dispenser 3, so that a related flow of water 15 is substantially vertical and enters the siphon 10 under satisfactory conditions of relatively high pressure and flow-rate.

Anyone skilled in the art will now be fully able to understand how the whole arrangement actually works to achieve the purpose of the present invention. The first offshoot conduit 7 conveys the water into the laundering product dispenser where this water dissolves and flushes away the laundering product and then flows into the siphon 10 through the conduit 9. The amount of such a flow of water is regulated so as to enable it to flush away the whole amount of laundering product from the compartments however, owing to the fact that this flow occurs downstream of the respective air break 8, it has a very low pressure. The speed of the flow is low enough so that it ultimately gives rise to practically no foam formation when it hits the mass of laundering product, which is dissolved and flushed away towards the siphon through the conduit 9. Furthermore, the practical absence of foam is ensured in the conduit 9 and at the inlet of the siphon 10, since the water there flows at almost no pressure and at a very low speed, as determined only by its falling by gravity into said conduit 9.

The second offshoot conduit 13 is, on the contrary, sized to convey the greatest part of the overall amount of water and its flow 16 coming out of the nozzle 15 is in fact quite impetuous since it is practically flowing directly from the water supply mains in a straightforward manner, i.e. without any hindrance or restraint.

In such a way said flow of water enters the conduit 9 and not only passes quickly through the siphon, but, by mixing with the flow coming from the dispenser, exerts a sucking and boosting action upon the latter, thereby accelerating the transfer of the whole amount of liquid into the washing tub.

Such an effect is further promoted by the substantial absence of foam in the flow coming from the laundering product dispenser 3, said foam being well-known to have a marked flow-braking action through the siphon.

In a most advantageous way, said siphon opens with its outlet nozzle 11 at a location situated in the upper portion of the bellows-like door gasket 12 of the machine. The siphon is directed toward the lower portion of the washload-containing drum, so that the water flowing out of it is sprayed directly onto the washload contained therein, thereby enhancing the washing effect.

A further advantage of the arrangement according to the present invention will, at this point, be fully appreciated. Such an arrangement may also be applied in washing machines which are not provided with a laundering product dispenser and in which the laundering product itself is added directly by the user into the drum before starting the washing process.

For application in these machines, it is sufficient that dispenser 3 and the devices associated therewith be removed. The offshoot conduit 13 will automatically take over and provide for the whole water filling process. The upper mouth 17 connecting the conduit 9 with the dispenser remains open, without giving rise to any particular problem since said connection mouth lies in a position which is higher than the normal level of the liquid in the tub and excludes any risk of spillage- The siphon preserves its function in retaining vapors and foam tending to escape from the tub.

Figure 4:
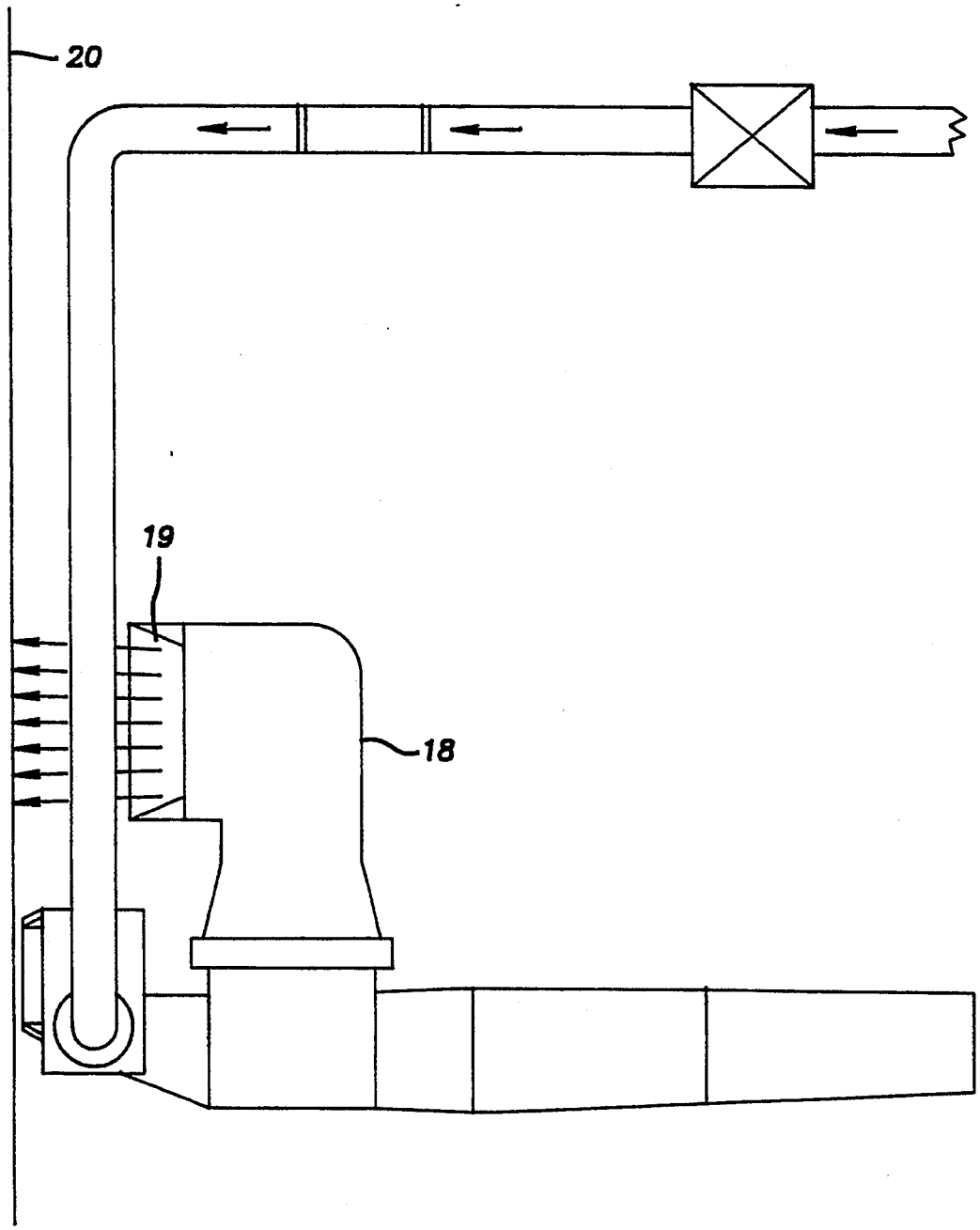
FIG. 4 is a partial schematical plan view from above of an alternative embodiment of the invention.

With reference to FIG. 4, in some cases a machine failure may cause the level of the liquid to rise to such an extent as to reach said mouth and, as a consequence, to spill out therefrom. Thus, it may be necessary (for reasons connected with special provisions set forth by applying standard regulations) to prevent any spilling liquid from dripping and scattering at random inside the machine cabinet. Said mouth is then connected to an appropriate conduit 18 whose outlet mouth 19 is arranged near a wall 20 of the cabinet and is oriented toward said wall, so that any liquid flowing out from said mouth 19 will diffuse against said wall to fall onto the bottom of the machine without flushing or wetting functional parts inside the machine.

It will be appreciated that the described arrangement according to the invention can be given any form and shape considered to be most appropriate on the basis of given space restraints or volume needs, and may therefore be embodied also in forms differing from he described one, without departing from the scope of the present invention.

What is claimed is:

1. A clothes washing machine, comprising a washing tub (1), a washload-holding drum (2) in the tub, a water inlet conduit (5) from water supply mains, an electromagnetic water-inlet valve (6) installed in said conduit, an offshoot conduit (7) from said water inlet conduit downstream of said electromagnetic valve, a water dispenser (3) associated with a plurality of detergent compartments (4) containing laundering products, a siphon (10) between said compartments and the washing tub, a first air break communicating, said offshoot conduit with said water dispenser and a conduit (9) between said siphon and said dispenser, wherein water is conducted from said water inlet conduit through said dispenser and compartments to said conduits, characterized in that the washing machine comprises a second offshoot water conduit from said water inlet conduit (13) provided between said electromagnetic water-inlet valve (6) and said siphon (10), said second offshoot water conduit (13) by-passing said dispenser so as to conduct water from said water inlet conduit to said siphon.

2. A clothes washing machine according to claim 1, characterized in that said second offshoot water conduit (13) is provided with a respective second air break (15).

3. A clothes washing machine according to claim 2, characterized in that said second air break (15) comprises an interruption through a nozzle (14) arranged in a vertical downward-running portion of said second offshoot conduit, and in that a flow of water (16) injected through said nozzle (14) enters said siphon (10) in a substantially vertical direction.

4. A clothes washing machine according to claim 3, characterized in that the washing tub includes a bellows-like door gasket and said siphon ends with an outlet nozzle (11) at a location situated in an upper portion of the bellows-like door gasket (12), said nozzle being oriented so that a jet of water flowing out of the siphon is directed against a washload placed in said drum.

5. A clothes washing machine according to claim 4, characterized in that the dispenser (3) and the compartments (4) are removable from the washing machine, and an upper mouth (17) of the conduit (9) is connected with an appropriate conduit (18) having an outlet mouth (19) arranged near a wall (20) of cabinet of the washing machine and is oriented toward said wall.

* * * * *

UNITED STATES PATENT AND TRADEMARK OFFICE

CERTIFICATE OF CORRECTION

PATENT NO. : 5,375,438

DATED : December 27, 1994

INVENTOR(S) : Piero Babuin

It is certified that error appears in the above-indentified patent and that said Letters Patent is hereby corrected as shown below:

Col. 4, line 45, "spillage" should be --spillage.--.

Col. 5, line 11, "communicating," should be --communicating--.

Col. 5, line 15, "conduits" should be --conduit--.

Col. 6, line 24, after the first occurrence of "of" please insert --a--.

Signed and Sealed this

Twenty-third Day of May, 1995

*Attest:*

*Attesting Officer*

BRUCE LEHMAN

*Commissioner of Patents and Trademarks*